United States Patent [19]

Bystedt et al.

[11] 4,139,035

[45] Feb. 13, 1979

[54] MEANS AND METHOD FOR MEASURING, ADJUSTING AND FEEDING OF LOGS INTO A SAW OR THE LIKE

[75] Inventors: Nils T. Bystedt, Järfälla; Karl B. Lundin, Bromma, both of Sweden

[73] Assignee: Kochums Industri Aktiebolag, Sweden

[21] Appl. No.: 832,622

[22] Filed: Sep. 12, 1977

[30] Foreign Application Priority Data

Sep. 10, 1976 [SE] Sweden ..... 7610080

[51] Int. Cl.[2] ..... B27B 1/00

[52] U.S. Cl. ..... 144/312; 83/56; 83/71; 83/367; 144/209 A

[58] Field of Search ..... 144/312, 209 A; 83/71, 83/371, 56, 367

[56] References Cited

U.S. PATENT DOCUMENTS

| | | | |
|---|---|---|---|
| 3,596,691 | 8/1971 | Broadfoot | 144/312 X |
| 3,648,743 | 3/1972 | Fino et al. | 144/312 X |
| 3,746,065 | 7/1973 | Mason | 144/209 A |
| 3,806,253 | 4/1974 | Denton | 144/312 X |
| 3,842,874 | 10/1974 | Noriyuki et al. | 144/209 A |

*Primary Examiner*—J. M. Meister

*Attorney, Agent, or Firm*—Hill, Gross, Simpson, Van Santen, Steadman, Chiara & Simpson

[57] ABSTRACT

A method and means for adjusting a log into a position in front of a saw necessary to obtain a maximum yield. The log is turned in such a manner that any curvature is positioned in a plane parallel to the plane of the saw members and is then is displaced sidewardly in such a manner that a plane containing the log end centers becomes properly positioned in relation to the plane of the saw members. The positioning of the log into the desired rotational position is carried out at a point to the side of the saw line with a simultaneous scanning of the log dimensions electronically and storing of such information in a computer. The log, having been turned into the desired rotational position, is then held in that position and is fed laterally generally into the saw line where the log is side-adjusted into a proper orientation longitudinally in relation to the saw members. The side-adjustment is performed, based on information stored in the computer, in such a manner that each individual log gives maximum yield with respect to its dimensions, and any other data stored in the computer such as the current demand and current market conditions.

5 Claims, 2 Drawing Figures

II
II

MEANS AND METHOD FOR MEASURING, ADJUSTING AND FEEDING OF LOGS INTO A SAW OR THE LIKE

FIELD OF THE INVENTION

This invention relates to means and a method for measuring, adjusting and feeding of logs into a saw or the like.

BACKGROUND OF THE INVENTION

The ever increasing shortage of wooden raw material has strongly stressed the need for a better utilization of the raw material at the saw mills. To achieve the best possible yield and thus also the best possible economy it is, of course, a general desire that the logs should be properly adjusted in relation to the sawing members, viz. both with respect to the rotational position of the logs and with respect to the orientation and position of the longitudinal axis of the logs.

A key factor in this regard was previously an operator who was responsible for the proper adjustment of the logs. It was considered that a proper position has been reached when the log, by rotation thereof, has been turned into a best position with respect to any longitudinal curvature of the log and the log had been placed right in front of the saw. Usually, when this adjustment was carried out the operator was placed at distance of about 10 m away from the log end adjacent the saw. Sometimes, the operator had to his aid reference lines projected on the log, which lines to a certain extent facilitated the centering and side-adjustment of the logs. However, as the production rate should be high, such as 10–15 logs/min., and the distance to the log end was comparatively great, the centering and side-adjustment of the logs in relation to the sawing means often turned out to be rather bad, which resulted in waste of raw material and bad economy.

During recent years quite a few different methods and means have been proposed for an automatic measuring of the logs, to enable a subsequent turning of the logs into a proper rotational position, but as such automatic measuring equipment is comparatively complex and expensive, in many cases a visual classification of the logs is still applied.

OBJECTS OF THE INVENTION

One important object of the present invention is the provision of means for measuring, adjusting and feeding of logs into a saw or the like by the use of which the drawbacks and limitations of prior art means and methods are avoided.

SUMMARY OF THE INVENTION

Means for measuring, adjusting and feeding of logs into a saw or the like comprises means for positioning the log into the desired rotational position disposed at a point beside the saw line with a simultaneous scanning of the log dimensions electronically and storing of such information in a computer, and the log, having been turned into the desired rotational position, while this position is maintained is fed laterally generally into the saw line, where the log is side-adjusted into a proper orientation longitudinally in relation to the saw members, in response to the information stored in the computer, in such a manner that each individual log gives maximum yield with respect to its dimensions and any other data in the computer.

DESCRIPTION OF THE DRAWINGS

A more thorough understanding of the invention may be obtained from the following detailed description taken in connection with the accompanying drawings in which.

DESCRIPTION OF THE PREFERRED EMBODIMENT

Figures 1, 2:
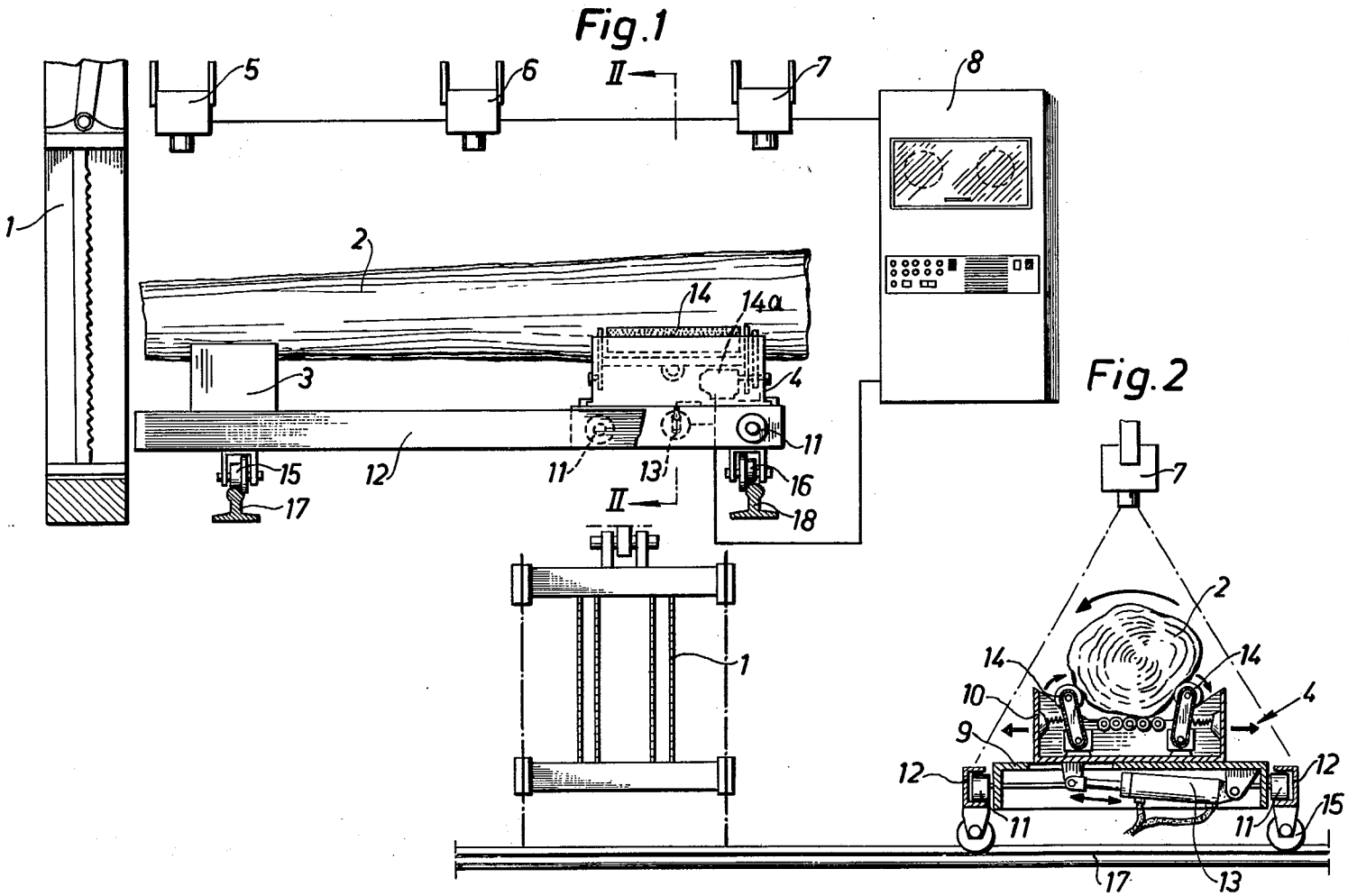
FIG. 1 is a diagrammatical side elevation of one embodiment of the present invention.
FIG. 2 illustrates a section along the line II—II in FIG. 1.

As shown in FIG. 1, the apparatus includes a gang saw 1 having a plurality of saw blades which move up and down. In front of the saw 1, a foremost log carriage 3 and a rearmost log carriage 4, which may be essentially identical, are adapted to support a log 2 thereon. Both of the carriages may move the log both longitudinally and transversely. Further, the log carriages 3 and 4 are constructed in such a manner that the log may be turned or rotated as it rests on these carriages. Above the log there are disposed three cameras 5–7 of the scanning type which are connected to a computer 8.

As shown in FIG. 2, the rearmost log carriage 4 has a bottom portion 9 and a top portion 10. The bottom portion 9 has a set of wheels 11, running in a pair of longitudinal rails 12. The top portion 10 is transversely movable on the bottom portion 9 by means of a hydraulic cylinder 13. Further, the top portion 10 has a set of rollers 14 on which the log rests and which are driven by means of a motor **14*a*. The carriages 3,4 and their rails 12 are carried, by means of a set of wheels 15,16, on a pair of transverse rails 17,18**, which are conveniently constructed as endless loops, for a purpose explained below.

The apparatus operates in the following way: A log 2 which has been fed into the sawmill, debarked and round reduced in the ordinary way is fed into the apparatus and placed onto the log carriages 3,4 in a position as set forth in FIG. 2. With the log in this position the scanning cameras 5,6 and 7 scan the contour lines of the log and the position of these lines, i.e., where the log is situated in the picture field of the respective cameras. Corresponding signals are fed to the computer 8 which, based on the signals from the cameras 5 and 7 above the log ends, determines the position of the log center at the end portions. Also, the computer 8 determines a reference line running between these centers. The signal from the camera 6 is utilized to determine where the centerline of the log is situated in a horizontal plane, at the location of this camera 6.

If the log has a curvature, which most of the logs have, and this curvature does not happen to be turned upwardly or downwardly, then the center line as determined by the camera 6 will be disposed at some distance from the reference line as determined by the computer. This distance will vary as the log is turned (rotated) by means of the log carriages 3,4. The computer is adapted to compare the position of the log center as determined by means of the camera 6 with the position of the reference line, at the location of the said camera 6 to detect when the spacing therebetween is idealized at a minimum and ideally is zero. In this position the computer 8 gives a signal to stop further turning of the log. Normally, it should not be necessary to permit the turning to proceed beyond 180°. Sometimes it may be necessary to turn the log slightly backwardly, when the said minimum value has been passed, so as to establish the desired rotational position. With the log in the desired rotational position, the curvature of the log is directed either upwardly or downwardly, which enables the best possible yield in a gangsaw 1 having its blades disposed vertically.

Then the log 2 is locked in the attained rotational position by means of suitable locking means (not shown), and then the log is fed laterally into the saw line by moving the carriages 3,4 along the rails 17,18. During that movement, or as the log has been positioned broadly in the saw line, the log 2 is side-adjusted with respect to a computer reference line, which computer reference line is stored in the computer and is fixed in relation to the saw 1 or may be displaced in relation thereto in dependence of log size, log shape, marked conditions and other conditions, which may vary from time to time. The side-adjustment may be carried out, so as to place the log centerline coinciding with the computer reference line, to deviate from and form any suitable angle therewith (so that one side of the log will be parallel to the computer reference line for so called double taper sawing), or to place the log centerline running parallel to but slightly spaced from the computer reference line. The side-adjustment of the log 2 is, in this case, carried out by admitting fluid selectively to the hydraulic cylinder 13 of the carriage 3 or the carriage 4, respectively.

It has been assumed above that the cameras should be disposed above the log and that the saw has vertical saw blades. If the cameras, instead, are disposed by the side of the log, then the computer should be arranged to idealize by maximizing the above discussed spacing. More than three cameras or similar scanning devices may be used.

In the example shown, the logs are turned into a desired rotational position while they are disposed at the side of the sawline. Therefore, the scanning of the dimensions of the respective logs, the proper turning thereof and the evaluation of all the available data may be carried out while the preceeding log is being sawed. Then, as this sawing is almost completed, the next log, in correct rotational position, is moved into the saw line, and is side-adjusted, where upon the longitudinal feeding thereof is commenced. Such mode of operation requires at least two sets of log carriages or the like. Alternatively, the apparatus may comprise an ordinary log turner, means for transfer of the logs sidewardly in an unchanged rotational position, means for side-adjustment of the logs, and, finally, means for feeding the logs longitudinally thereof to the sawing means.

Modifications and alterations as to details may be carried out within the scope of the inventive idea.

What we claim is:

1. Apparatus for adjusting the position of a curved log to be fed endwise against a planar saw, comprising:

(a) means for determining the locations of the ends of the log's center axis in one plane;

(b) a computer for electronically determining a theoretical reference line which connects the axis ends with each other;

(c) means for determining the location of the log's center axis at a point between the log ends, in said one plane;

(d) means for electronically comparing the distance between the last mentioned axis location with the position of the reference line at said point; and (e) means for turning the log until said distance is optimized;

whereby a maximum amount of the log axis curvature is disposed in the plane of the saw.

2. Apparatus according to claim 1, (a) said first-named determining means comprising a pair of scanning cameras disposed to scan the contour lines of the log from above, and the locations of said lines, for transmitting corresponding signals to said computer;

(b) said second-named determining means comprising a further camera disposed to scan the contour lines of the log from above at said point for transmitting corresponding signals to said computer; and (c) said turning means being under the control of said computer;

whereby said distance is automatically optimized as a minimum distance.

3. A method for adjusting the position of a curved log to be fed endwise against a planar saw to minimize the amount of log axis curvature lying out of a plane parallel to the plane of the saw, comprising the steps of:

(a) determining the locations of the ends of the log's center axis in one plane;

(b) utilizing these locations to electronically determine a theoretical reference line which connects the axis ends with each other;

(c) determining the location of the log's center axis in said one plane at a point between the log ends;

(d) electronically comparing the distance between the last-mentioned axis location with the position of the reference line at said point; and (e) turning the log until said distance becomes optimized.

4. A method according to claim 3 comprising the further steps of:

(a) locking the log in the attained rotational position;

(b) providing a second reference line which is fixed in relation to the plane of the saw;

(c) electronically comparing the position of said theoretical reference line with said second reference line for coincidence; and (d) in response to any lack of coincidence, shifting the ends of the log in a horizontal plane to attain said coincidence.

5. A method for adjusting the position of a curved log to be fed endwise along a saw line against a planar saw, comprising the steps of:

(a) at a location laterally offset from the saw line, simultaneously electronically scanning the log dimensions and storing such information in a computer;

(b) at said location, under the control of the computer, rotating the curved log to place the curvature of the log in a plane parallel to the plane of the saw;

(c) locking the rotational position of the log;

(d) feeding the log laterally away from said location and generally into the saw line;

(e) under the control of the computer and in response to information stored therein, independently adjusting the positions of the ends of the log in a direction transverse to said saw line; and (f) advancing said log endwise to the saw;

whereby a second log may be disposed at said location and scanned as soon as the first log has been laterally fed.

* * * * *